US007375648B1

(12) United States Patent
Mulka et al.

(10) Patent No.: US 7,375,648 B1
(45) Date of Patent: May 20, 2008

(54) VEHICLE OCCUPANCY IDENTIFICATION SYSTEM

(75) Inventors: Edward A Mulka, Mt. Laurel, NJ (US); Thomas N. Kollar, Cinnaminson, NJ (US); Carol A. Bozarth, Maple Shade, NJ (US); Helmut Rieder, Graz (AT); Martin Sauerschnig, Graz (AT)

(73) Assignee: Efkon USA, Inc., Dallas, TX (US)

( * ) Notice: Subject to any disclaimer, the term of this patent is extended or adjusted under 35 U.S.C. 154(b) by 224 days.

(21) Appl. No.: 11/257,195

(22) Filed: Oct. 24, 2005

Related U.S. Application Data

(60) Provisional application No. 60/622,374, filed on Oct. 28, 2004.

(51) Int. Cl.
*G08G 1/09* (2006.01)

(52) U.S. Cl. ..... 340/905; 340/917; 340/539.1

(58) Field of Classification Search ..... 340/905, 340/906, 917, 919, 928, 933, 936, 937, 539.1; 701/200, 201, 207, 209
See application file for complete search history.

(56) References Cited

U.S. PATENT DOCUMENTS

| | | | | |
|---|---|---|---|---|
| 4,591,823 | A * | 5/1986 | Horvat | 340/936 |
| 5,289,183 | A | 2/1994 | Hassett et al. | |
| 6,384,740 | B1 * | 5/2002 | Al-Ahmed | 340/936 |
| 6,967,592 | B2 * | 11/2005 | Bell et al. | 340/905 |
| 6,988,034 | B1 * | 1/2006 | Marlatt et al. | 701/200 |

* cited by examiner

*Primary Examiner*—Van T. Trieu
(74) *Attorney, Agent, or Firm*—Locke Lord Bissell & Liddell, LLP

(57) ABSTRACT

An in-vehicle transponder communicates with roadside readers to transmit a data stream of information that has been previously presented to the transponder. The transponder accepts multiple data cards and the identification numbers of the vehicle occupants for transmission to roadside transceivers.

2 Claims, 1 Drawing Sheet

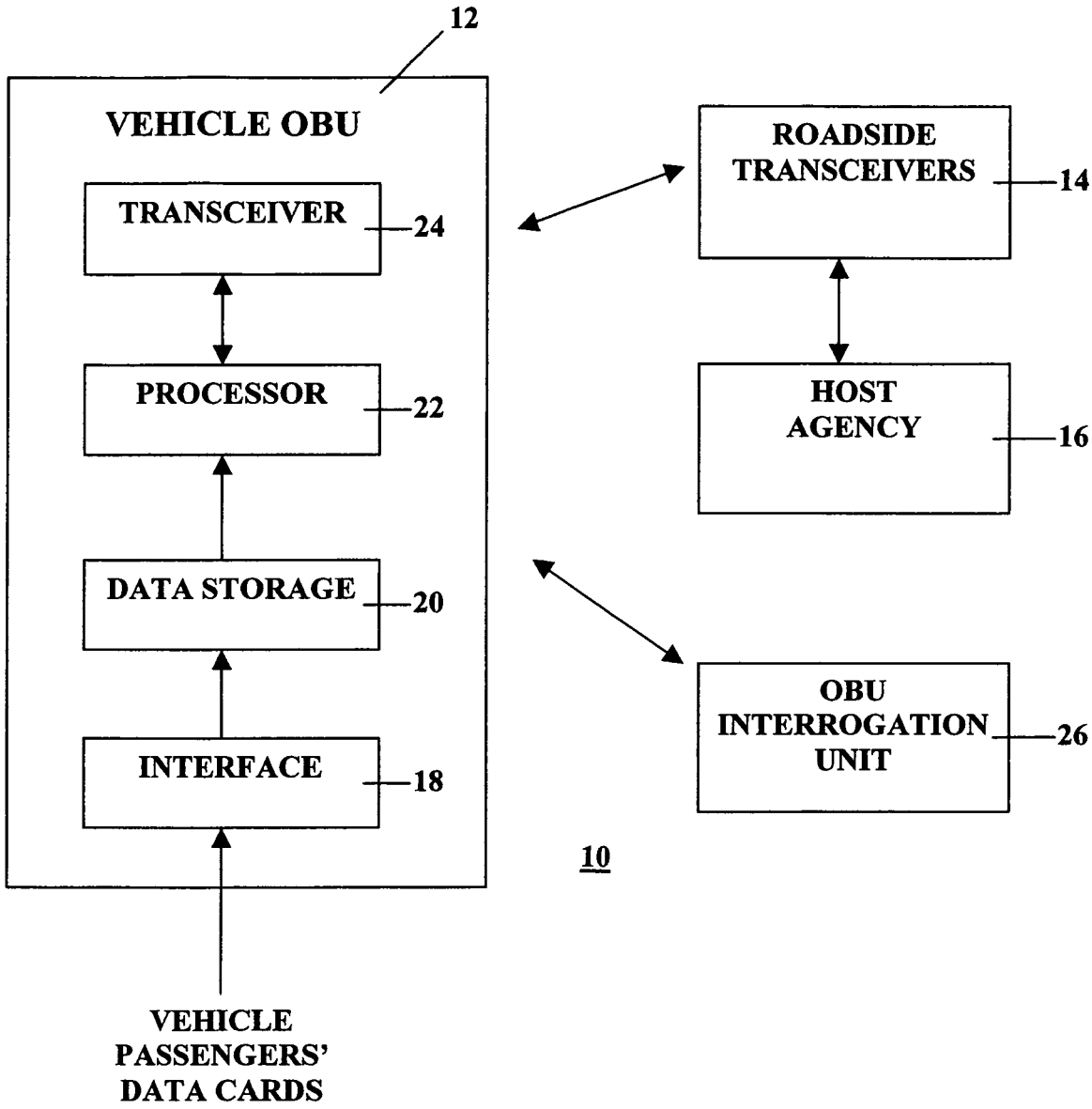
12
VEHICLE OBU
TRANSCEIVER
24
PROCESSOR
22
DATA STORAGE
20
INTERFACE
18
ROADSIDE TRANSCEIVERS
14
HOST AGENCY
16
OBU INTERROGATION UNIT
26
10
VEHICLE PASSENGERS' DATA CARDS

VEHICLE OCCUPANCY IDENTIFICATION SYSTEM

RELATED APPLICATION

This application claims the benefit of U.S. provisional patent application Ser. No. 60/622,374, filed Oct. 28, 2004 and entitled "Vehicle Occupancy Identification."

TECHNICAL FIELD OF THE INVENTION

The present invention relates to vehicle traffic monitoring and management, and more particularly to a system for identifying vehicle occupancy for monitoring managed lane traffic.

BACKGROUND OF THE INVENTION

An increasing number of vehicles are traveling over progressively more congested transportation networks. In an effort to relieve such congestion, managed lanes, high occupancy vehicle (HOV) and high occupancy tolling (HOT) lanes are utilized where two or more occupants must be present in the vehicle. Although managed lanes decrease traffic and congestion, abuse of such lanes by vehicle operators is a continuing problem. Identification of vehicle occupancy is an important component of managed lane management and operation. Enforcement of multiple occupants in a vehicle traveling in a managed lane, typically requires law enforcement personnel to visually confirm two or more occupants in a vehicle. This monitoring is tedious and unreliable, costly and time consuming. Therefore, a need exists for an electronic monitoring system to verify vehicle occupancy to improve the use and benefit of managed lanes.

SUMMARY OF THE INVENTION

In accordance with the present invention, an in-vehicle transponder communicates with roadside readers to transmit a data stream of information that has been previously presented to the transponder. The transponder accepts multiple data cards and the identification numbers of the vehicle occupants for transmission to roadside transceivers.

BRIEF DESCRIPTION OF THE DRAWINGS

For a more complete understanding of the present invention and for further advantages thereof, reference is now made to the following Description of the Preferred Embodiments taken in conjunction with the accompanied Drawing which is a system block diagram of the present invention.

DESCRIPTION OF THE PREFERRED EMBODIMENTS

Referring to the FIGURE, the present vehicle occupancy identification system is illustrated, and is generally identified by the numeral 10. System 10 includes an in-vehicle on-board unit (OBU) 12 which is located in vehicles traveling on a roadway and, particularly within managed HOV and/or HOT lanes. OBU 12 communicates with multiple roadside transceivers 14 which are positioned along a roadway. Transceivers 14 communicate with a host agency 16 to confirm eligibility of vehicle traffic in the managed lanes.

Each OBU 12 within a vehicle accepts a vehicle passengers' data card, such as, for example, a smart card which includes an identification number representing a vehicle occupant. An interface 18 is provided within OBU 12 for reading the data card. The information read from the data card by interface 18 is stored within data storage 20 for use by a processor 22. Processor 22 communicates with a transceiver 24 which in turn communicates information relating to the number of passengers traveling within a vehicle to roadside transceivers 14.

Multiple data cards are sequentially inserted into interface 18. Vehicle passengers insert and remove data cards one at a time as single reads in OBU 12. Passengers present their data cards individually to interface 18 for storage of data within data storage 20. Each occupant of the vehicle registers their data card with the OBU 12 prior to entering a lane read zone.

Spot check of vehicles traveling in managed lanes is accomplished using a roadside-to-vehicle interrogation of the OBU 12 utilizing an interrogation unit 26 in a stationary or mobile environment. Interrogation unit 26 communicates with transceiver 24 of OBU 12 to provide an on the spot, real time, confirmed enforcement by reading the data stored within OBU 12 relating to the number of data cards read in the vehicle under interrogation. Data card transactions are processed and stored in OBU 12 prior to a vehicle entering a managed lane read zone, such that sufficient time exists for OBU 12 to transmit its data to roadside transceivers 14.

Having described specific embodiments of the present invention, it will be understood that modifications thereof may be suggested to those skilled in the art, and it is intended to cover all such modifications as fall within the scope of the appended claims.

The invention claimed is:

1. A system for analysis and management of managed lane vehicle traffic along a roadway comprising:

a plurality of roadway transceivers positioned adjacent to the roadway, each of said roadway transceivers in communication with vehicles traveling on the roadway;

a plurality of transponders, each of said transponders located in separate ones of the vehicles traveling on the roadway, each of said transponders including a data processor, memory and a vehicle transceiver, intercoupled such that communication from said roadway transceivers can be received, and processed in said data processor, and said vehicle transceivers can communicate vehicle information to said roadway transceivers; and said memory operable for receiving passenger identification information received from each passenger traveling in vehicles traveling on the roadway and for storing data representing the number of passengers traveling in said separate ones of the vehicles traveling on the roadway for transmission to said plurality of roadway transceivers upon interrogation of a vehicle transponder.

2. The system of claim 1 wherein said memory receives said passenger identification information from a data card reader located in said separate ones of the vehicles traveling on the roadway and wherein passenger data cards uniquely identify passengers traveling in said separate ones of the vehicles traveling on the roadway.

* * * * *